US007803460B2

(12) United States Patent
Lee et al.

(10) Patent No.: US 7,803,460 B2
(45) **Date of Patent: *Sep. 28, 2010**

(54) FILAMENT BUNDLE TYPE NANO FIBER AND MANUFACTURING METHOD THEREOF

(75) Inventors: Jae Rock Lee, Daejun (KR); Seung Yong Jee, Daejun (KR); Hyo Joong Kim, Daejun (KR); Young Taik Hong, Daejun (KR); Seok Kim, Daejun (KR); Soo Jin Park, Daejun (KR)

(73) Assignee: Korea Research Institute of Chemical Technology, Daejun (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/554,448

(22) Filed: Sep. 4, 2009

(65) Prior Publication Data

US 2010/0021732 A1 Jan. 28, 2010

Related U.S. Application Data

(62) Division of application No. 11/570,663, filed as application No. PCT/KR2004/002385 on Sep. 17, 2004.

(30) Foreign Application Priority Data

Jun. 17, 2004 (KR) ..... 2004-0044902

(51) Int. Cl.
*B32B 19/00* (2006.01)

(52) U.S. Cl. ..... 428/357; 428/364; 525/432; 528/350

(58) Field of Classification Search ..... 428/357, 428/370, 373, 364; 525/432; 528/350
See application file for complete search history.

(56) References Cited

U.S. PATENT DOCUMENTS 4,127,706 A 11/1978 Martin et al.

(Continued)

FOREIGN PATENT DOCUMENTS

KR 20000011018 2/2000

(Continued)

*Primary Examiner*—N. Edwards
(74) *Attorney, Agent, or Firm*—K&L Gates LLP

(57) ABSTRACT

A filament type nano-sized lone fiber and a method of producing the same are disclosed. In the method, a spinning solution or a spinning melt is electro-spun in drops using a spinneret to which a critical voltage is applied, and the spun drops are continuously collected on a multi-collector. The spinning solution is produced dissolving a blend or copolymer consisting of two or more kinds of polymers in a solvent. The spinning melt is produced by melting the polymers. The multi-collector is selected from the group consisting of a plate type collector, a roll type collector, and a combination thereof. The filament type nano-sized long fiber is processed into a yarn through one step during the electrospinning process, and thus, mechanical properties are better than those of conventional nanofiber non-woven fabric. Consequently, the filament type nano-sized long fiber can be utilized for the extended application.

5 Claims, 8 Drawing Sheets

U.S. PATENT DOCUMENTS

| | | | | |
|---|---|---|---|---|
| 5,532,334 | A * | 7/1996 | Choi et al. | 528/350 |
| 5,955,568 | A * | 9/1999 | Choi et al. | 528/351 |
| 6,183,670 | B1 | 2/2001 | Torobin et al. | |
| 6,433,184 | B1 * | 8/2002 | Choi et al. | 548/476 |
| 6,713,011 | B2 | 3/2004 | Chu et al. | |
| 6,790,528 | B2 * | 9/2004 | Wendorff et al. | 428/376 |
| 7,134,859 | B1 * | 11/2006 | Sorensen | 425/82.1 |
| 7,264,762 | B2 * | 9/2007 | Ko et al. | 264/465 |
| 7,390,450 | B2 * | 6/2008 | Hoeks et al. | 264/171.13 |
| 2003/0215624 | A1 | 11/2003 | Layman et al. | |
| 2005/0067732 | A1 | 3/2005 | Kim et al. | |
| 2005/0253305 | A1 | 11/2005 | Kim et al. | |
| 2006/0153904 | A1 * | 7/2006 | Smith et al. | 424/448 |
| 2006/0246798 | A1 * | 11/2006 | Reneker et al. | 442/59 |
| 2007/0035055 | A1 | 2/2007 | Gee et al. | |
| 2007/0144124 | A1 * | 6/2007 | Schewe et al. | 55/487 |
| 2009/0255226 | A1 * | 10/2009 | Kohli et al. | 55/379 |
| 2009/0294733 | A1 * | 12/2009 | Branham et al. | 252/500 |
| 2010/0031617 | A1 * | 2/2010 | Ensor et al. | 55/487 |

FOREIGN PATENT DOCUMENTS

| | | |
|---|---|---|
| KR | 20020050381 | 6/2002 |
| KR | 20030003925 | 1/2003 |
| KR | 20030077384 | 10/2003 |
| KR | 20030093892 | 12/2003 |
| KR | 20040040692 | 5/2004 |
| WO | 02/50346 | 6/2002 |

* cited by examiner

FILAMENT BUNDLE TYPE NANO FIBER AND MANUFACTURING METHOD THEREOF

CROSS REFERENCE TO RELATED APPLICATIONS

This application is a divisional of the U.S. application Ser. No. 11/570,663, filed Mar. 27, 2007, which is a National Stage of International Application No. PCT/KR04/002385 filed on Sep. 17, 2004 the content of which is expressly incorporated herein by reference thereto.

TECHNICAL FIELD

The present invention relates to a filament type nano-sized long fiber and a method of producing the same. More particularly, the present invention pertains to a filament type nano-sized long fiber and a method of producing the same using an improved electrospinning process. In the method, a spinning solution or a spinning melt is electro-spun in drops using a spinneret to which a critical voltage is applied, and the spun drops are continuously collected on a multi-collector. In this regard, the spinning solution is produced by dissolving a blend or copolymer consisting of two or more kinds of polymers in a solvent. The spinning melt is produced by melting the polymers. Furthermore, the multi-collector is selected from the group consisting of a plate type collector, a roll type collector, and a combination thereof.

BACKGROUND ART

A nanofiber is an ultra-fine fiber having a diameter of 1-800 nm, and has various physical properties that cannot be gained from a conventional fiber. Accordingly, a web, composed of the nanofiber, as a membrane type porous material may be usefully applied to various fields, such as filters, wound dressings, artificial supporters, defensive clothes against biochemical weapons, separation membranes for secondary batteries, and nanocomposites.

A representative example of a conventional process of producing the nanofiber includes an electrospinning process where a raw material solution of a fiber is spun while being charged to produce a fiber having a very small diameter. Examples of the production of the nanofiber using the electrospinning process are disclosed in Korean Pat. Laid-Open Publication Nos. 2000-11018, 2003-3925, and 2003-77384, and U.S. Pat. No. 6,183,670. However, the nanofiber produced according to the conventional electrospinning process is limited to a non-woven fabric type. With respect to this, Doshi et al. assert that nanofibers are produced in a form of nanoweb, that is, non-woven fabric, because, when drops, which consist of a polymer solution and are formed at a tip of a spinneret, burst by an applied high voltage and are then collected on a collector to produce the nanofibers through the conventional electrospinning process, the nanofibers are anisotropically oriented in the collector [Doshi and Reneker, "Electrospinning Process and Application", *Journal of Electrostatics,* 1995, 35, 151-160].

Furthermore, they point out a problem that since the non-woven fabric type nanofiber consists of a single fiber, while the drops, which are formed at the tip of the spinneret during the electrospinning process, are spun toward the collector at a critical voltage ($V_c$), the single fibers collide with each other before the drops reach the collector. Consequently, the single fibers are interfered or combined with each other, causing conglomeration. With respect to this, Korean Pat. Laid-Open Publication No. 2002-50381 discloses the production of a nanofiber employing a copolymer of polyethylene terephthalate and polyester, instead of a single component, as a spinning solution through a conventional electrospinning process. However, that nanofiber does not break from a non-woven fabric type, either. The non-woven fabric type nanofiber has very poor mechanical strength. Particularly, if the nanofibers are intertwined into a thread, undesirably, an additional connection fiber is required to connect the single fibers to each other, and the final thread is readily broken. Accordingly, there remains a need to improve the non-woven fabric type nanofiber so as to be applied to various fields.

Therefore, the present inventors have conducted studies into the production of a nanofiber capable of being applied to various fields, resulting in the finding of the following fact. In a procedure of producing the nanofiber where drops, which consist of a polymer solution and are formed at a tip of a spinneret, burst by an applied high voltage to be collected on a collector according to a conventional electrospinning process, after the polymer solution is spun to one or more first collectors to produce the nanofiber, the nanofiber, which is collected on the first collector, is recollected onto a second collector to be continuously collected thereon, thereby continuously producing a filament type nanofiber having mechanical properties that are better than a conventional nanofiber. Based on the above finding, the present inventors accomplished the present invention.

DISCLOSURE OF THE INVENTION

Technical Objects

An object of the present invention is to provide a filament type nano-sized long fiber.

Another object of the present invention is to provide a method of producing a filament type nano-sized long fiber. In the method, a spinning solution or a spinning melt is electro-spun in drops using a spinneret to which a critical voltage is applied, the spun drops are collected on one or more first collectors to form a nanofiber, and the nanofiber, which is collected on the first collectors, is recollected onto a second collector to be continuously collected thereon. In this regard, at least one collector revolves.

A further object of the present invention is to provide a method of producing a filament type nano-sized long fiber, which is realized by a design of a molecular structure suitable in electrospinning, or an optimum combination condition of compounds having such molecular structure.

Technical Solution

In order to accomplish the above objects, the present invention provides a filament type nano-sized long fiber produced through a process which comprises electrospinning a spinning solution or a spinning melt in drops using a spinneret to which a critical voltage is applied, and continuously collecting the spun drops in a multi-collector. The spinning solution is produced by dissolving a blend or copolymer consisting of two or more kinds of polymers in a solvent. The spinning melt is produced by melting the polymers. The multi-collector is selected from the group consisting of a plate type collector, a roll type collector, and a combination thereof.

In this regard, each of the polymers is a mixture of two or more selected from the group consisting of polyimide, polyamide, polyethylene, polypropylene, polyester, polyvinylidene fluoride, polyacrylonitrile, polysulfone, and polyethylene oxide. More preferably, each of the polymers contains one or more amine groups selected from the group consisting of monoamine, diamine, triamine, and tetramine. It is most preferable to use a polyamide-polyimide copolymer as that polymer. The solvent is any one selected from the group consisting of N-methyl-2-pyrrolidone, γ-butyrolactone, 2-butoxyethanol, dimethylacetamide, and dimethylformamide. Additionally, the present invention provides a filament yarn consisting of a nano-sized long fiber having a diameter of 10-500 nm.

The present invention provides a method of producing the nano-sized long fiber having the diameter of 10-500 nm. More specifically, the method comprises 1) preparing a spinning solution, in which 10-50 wt % of blend or copolymer consisting of two or more kinds of polymers is dissolved in a solvent, or a spinning melt, which is produced by heating the polymers at a melting point or higher to melt the polymers, 2) electrospinning the spinning solution or the spinning melt in drops using a spinneret to which a critical voltage is applied, and 3) discharging the spun drops onto a first collector to produce nanofibers, and recollecting the nanofibers, which are collected on the first collector, on a second collector to continuously collect the nanofibers. At least one of the first and second collectors rotates. Furthermore, one or more collectors may be further employed in addition to the first and second collectors.

The first collector consists of a metal plate or mesh made of an electrically conductive material, and is fixed or rotates at 10-1000 rpm. It is preferable to use the plate-type first collector. The second collector consists of a glass or plastic tube or rod made of a material capable of generating static electricity, or a tube or rod coated with the material. As well, it is preferable that the second collector be a roll type and rotate at 20-80 rpm.

In the method of the present invention, during the electrospinning process, it is preferable that a distance between the spinneret and the first collector be 5-20 cm, and that a distance between the first and second collectors be 3-25 cm.

Advantageous Effects

As described above, a filament type nano-sized long fiber, which is produced using an improved electrospinning process according to the present invention, has mechanical properties that are better than a conventional nanofiber non-woven fabric, thereby being applied as a substitute to all fields employing a conventional fiber having a micron-sized diameter. For example, first, the fiber of the present invention is useful as medical filters for kidney dialysis and purification of the blood, and various membrane reinforcing materials for genetic separation.

Second, the fiber of the present invention is useful to produce ultra-thin reinforcing films and ultra-slim PCBs in electric/electronic fields.

Third, the fiber of the present invention may be useful for ultra-small and ultra-light flying bodies or unmanned flying robots.

Fourth, the fiber of the present invention is useful as a reinforcing material for an optical cable in an optical communication field.

BEST MODE FOR CARRYING OUT THE INVENTION

Hereinafter, a detailed description will be given of the present invention. The present invention provides a filament type nano-sized long fiber produced through a process which comprises electrospinning a spinning solution or a spinning melt in drops using a spinneret to which a critical voltage is applied, and continuously collecting the spun drops in a multi-collector. The spinning solution is produced by dissolving a blend or copolymer consisting of two or more polymers in a solvent, and the spinning melt is produced by melting the polymers. The multi-collector is selected from the group consisting of a plate type collector, a roll type collector, and a combination thereof.

More specifically, in the electrospinning, after the drops are spun onto a first collector to form a nanofiber, the nanofiber, which is collected on the first collector, is recollected onto a second collector to be continuously collected thereon.

At this time, at least one of the collectors rotates. Thereby, a nano-sized filament yarn is provided in the type of a bunch of continuous yarns. The filament yarn has a diameter of 10-500 nm and has a twisting property (FIGS. 2, 5, 7, 9, 11, and 13).

Figure 15:
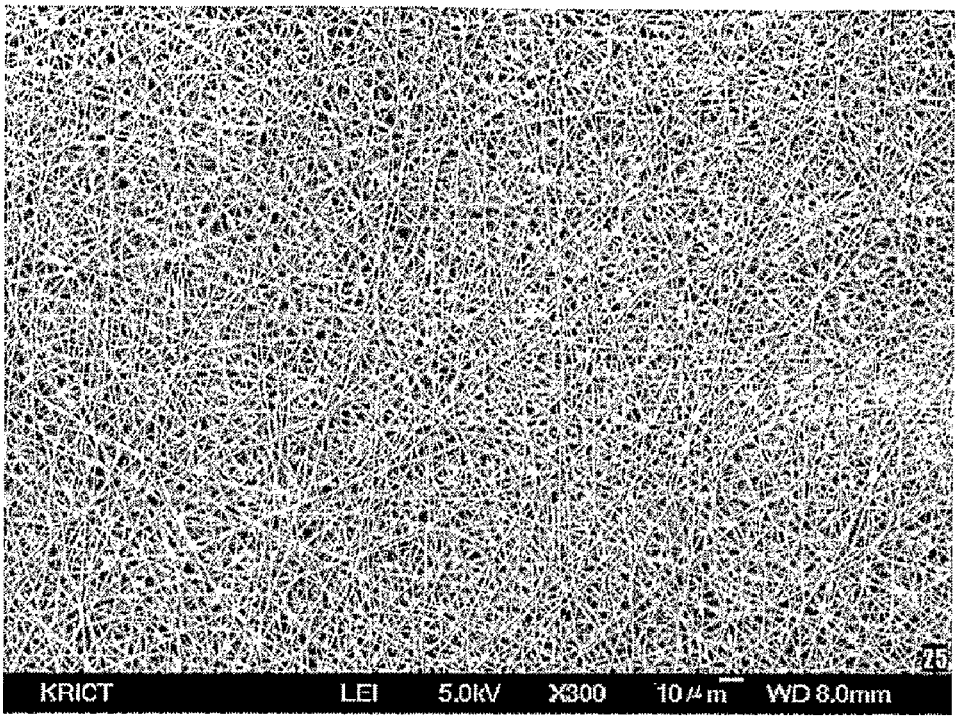
FIG. 15 is a SEM image of a surface of a nanofiber produced according to the conventional electrospinning process employing the single collector, which is magnified 300 times.
Figure 16:
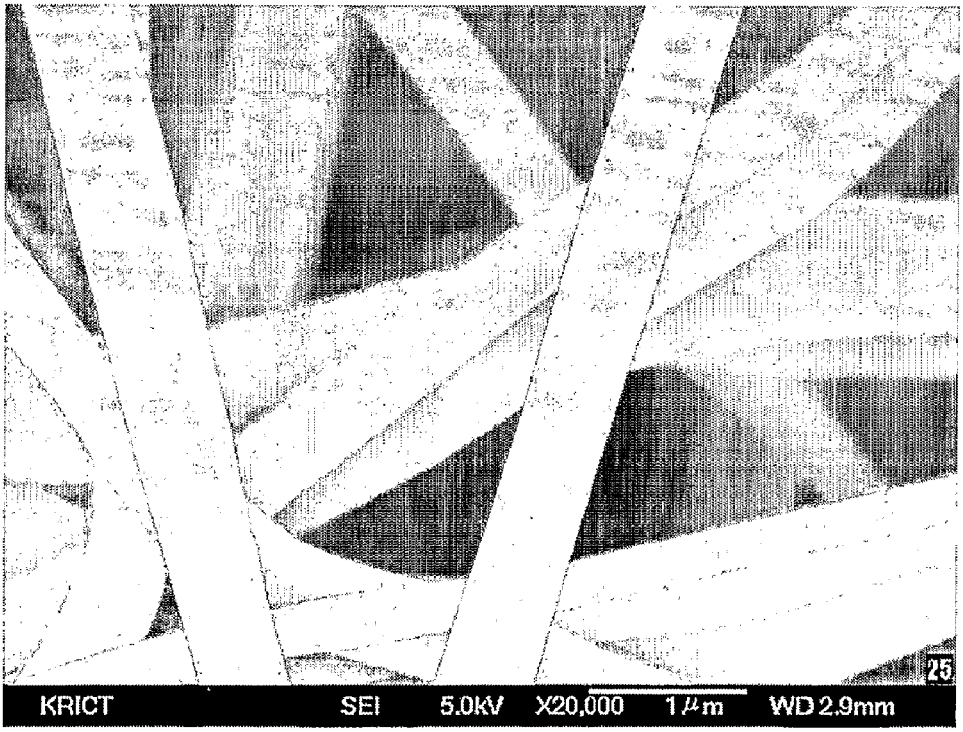
FIG. 16 is a SEM image of the surface of the nanofiber produced according to the conventional electrospinning process employing the single collector, which is magnified 20,000 times.

On the other hand, when using a conventional electrospinning process, a nanofiber is produced in the type of net-shaped non-woven fabric (FIGS. 15 and 16). If staples are processed into a continuous yarn, undesirably, breaking may easily occur because the staples must be connected to each other. However, in the present invention, the continuous yarn is produced through a continuous process, and thus, the nanofiber can be produced through one process without breakage of the nanofiber.

1. Production of a Spinning Solution or a Spinning Melt

A nanofiber of the present invention is realized by providing a design of a molecular structure suitable to an electrospinning process, or an optimum combination condition of compounds having such molecular structure.

In detail, any polymer may be used to produce the spinning solution of the present invention as long as it has excellent miscibility to a solvent and excellent mechanical strength. Illustrative, but non-limiting, examples of the polymer include a mixture of two or more selected from the group consisting of polyimide, polyamide, polyethylene, polypropylene, polyester, polyvinylidene fluoride, polyacrylonitrile, polysulfone, aid polyethylene oxide. More preferably, the polymer of the present invention includes one or more amine groups selected from the group consisting of monoamine, diamine, triamine, and tetramine. Diamine is selected from the group consisting of phenylenediamine, oxyphenylenediamine, and alkyl phenylenediamine.

Most preferably, the polymer is a polyamide-polyimide copolymer consisting of a compound, expressed by Formula 1, and another compound, expressed by Formula 2.

In Formula 1, it is preferable that in be 20-35 mol %. An this regard, when m is less than 20 mol %, undesirably, the polymer is excessively flexible because of low crystallinity. When m is more than 40 mol %, undesirably, the polymer is brittle because of poor impact resistance due to high crystallinity. Furthermore, it is preferable that n be 65-80 mol %. When n is less than 65 mol %, impact resistance is poor because of high crystallinity, and when n is more than 80 mol %, undesirably, it is excessively flexible because of low crystallinity.

The polyamide-polyimide copolymer (m+n) has a number average molecular weight of about 500-10,000. When the number average molecular weight is less than 500, viscosity and mechanical strength are low due to the low molecular weight. When the number average molecular weight is more than 10,000, undesirably, viscosity is excessively increased and it is hard to process the polymer according to an increase in the molecular weight.

Formula 1

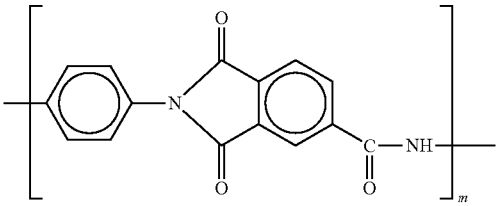

-continued

Formula 2

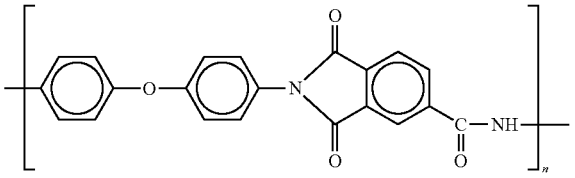

A polymer used in a conventional electrospinning process consists of one component phase, whereas the polymer used in the present invention is a blend or a copolymer consisting of two component phases. Accordingly, in the conventional electrospinning process, when a cone formed at a tip of a spinneret is spun at a critical voltage ($V_c$) toward a collector, single fibers collide with each other before they reach the collector, and thus, they are interfered or combined with each other, causing conglomeration, thereby creating a non-woven fabric type fine fiber. On the other hand, the use of the polymer blend or copolymer consisting of the two component phases according to the present invention prevents the interference or combination between single fibers, thereby producing a continuous yarn.

Any solvent capable of desirably dissolving the polymer may be used as the solvent of the present invention. Illustrative, but non-limiting, examples of the solvent are selected from the group consisting of N-methyl-2-pyrrolidone, γ-butyrolactone, 2-butoxyethanol, dimethylacetamide, and dimethylformamide. It is more preferable to use N-methyl-2-pyrrolidone.

Even though the same polymer is employed, an intrinsic critical voltage ($V_c$) may be changed depending on viscosity of the polymer solution. Furthermore, frictional force applied to the polymer solution depends on a diameter and a material of a spinneret, and thus, a speed of the polymer solution flowing toward the lowest stage of the spinneret, and a form of a cone-shaped drop may be changed depending on the diameter and the material. In this regard, the diameter and the material of the spinneret indirectly affects the formation of the cone-shaped drop during the electrospinning process, whereas a concentration of the polymer solution acts as a most important factor affecting that formation. Accordingly, a discharging speed of the polymer solution (ml/min) and the formation of the drop at the tip of the spinneret depend on the concentration of the polymer solution during the electrospinning process. With respect to this, it is preferable that the polymer solution of the present invention contain 10-50 wt % of polymer based on the solvent. When the concentration is less than 10 wt %, the breaking of the spun fiber occurs. When the concentration is more than 50 wt %, viscosity significantly increases, making a shape of the cone formed at the spinneret unstable.

Hence, in the present invention, if the electrospinning process is conducted employing the spinneret, which is provided with a tube that has a diameter of 0.42 mm and is made of stainless steel, it is preferable to use the spinning solution in which 25 wt % of polyamide-polyimide copolymer is dissolved in a N-methyl-2-pyrrolidone solvent. In this case, the discharging speed is 0.3 ml/min.

The spinning melt, which is produced by melting the polymer at a melting temperature or higher, may be applied to the electrospinning process instead of the spinning solution in which the blend or copolymer consisting of two or more components is dissolved in the solvent. In the present invention, a multi-collector is employed in the course of electrospinning the nanofiber to improve the conventional electrospinning process. Any material used in the conventional process may be applied to the nanofiber of the present invention. For example, a ceramic melt, a metal melt, an organic-inorganic hybrid melt, a metal-organic composite melt, a carbon melt, or a sol-gel solution may be employed, and the melt can be produced by heating the material at a phase transition temperature or higher.

2. Electrospinning Employing a Multi-Collector

In a method of producing a nanofiber according to the present invention, the multi-collector is employed during an electrospinning process to improve a conventional electrospinning process. In detail, a method of producing the nanofiber according to the present invention comprise 1) preparing a spinning solution, in which 10-50 wt % of blend or copolymer consisting of two or more kinds of polymers is dissolved in a solvent, or a spinning melt, which is produced by heating the polymers at a melting point or higher to melt the polymers, 2) electrospinning the spinning solution or the spinning melt in drops using a spinneret to which a critical voltage is applied, and 3) discharging the spun drops onto a first collector to produce nanofibers, and recollecting the nanofibers, which are collected on the first collector, onto a second collector to continuously collect the nanofibers. During the collection, at least one of the first and second collectors rotates.

In the method, one or more collectors may further employed in addition to the first and second collectors.

The first collector is made of an electric conductive metal plate or a metal mesh. A shape of the first collector is not limited, but it is preferable to use a plate-type collector, which is of a disk or rectangular shape. A size of the plate-type collector depends on viscosity of a polymer solution and a critical voltage ($V_c$) corresponding to the viscosity, and it is preferable that the size be the same as or larger than a collected area of the nanofiber produced by the spinning using the spinneret. Furthermore, it is preferable that a distance between the spinneret and the first collector be 5 to 20 cm. When the distance is less than 5 cm, the formation of a fiber is unstable because of formation of particles, and when the distance is more than 20 cm, the nanofiber deviates from a collector region, failing in economic efficiency. The first collector may be positioned perpendicular or parallel to the spinneret, and one or more first collectors may be employed. Additionally, the first collector may be fixed to a base or rotate at a predetermined speed. When the first collector rotates, the desirable speed depends on a twist of the desired nanofiber, and may be 10-1000 rpm. At this stage, when the speed is 10 rpm or less, the nanofiber is collected on only a specific portion because of the low speed. When the speed is 1000 rpm or more, the nanofiber is insufficiently formed from the spinneret and thus breaking of the nanofiber occurs, resulting in a reduced yield of the nanofiber.

The second collector is made of a material capable of generating static electricity, and may consist of a glass or plastic tube or rod, or a tube or rod coated with the material. The second collector is a roll-type collector rotating at 20-80 rpm. In this respect, a distance between the first and second collectors and the rotating speed depends on a diameter of the desired nanofiber, and may be determined so that the nanofiber is not broken. Preferably, the distance is 3-25 cm. If the distance is less than 3 cm, fibers are entangled, and if the distance is more than 25 cm, the fibers may be broken.

In a procedure of recollecting the nanofiber, which was collected on the first collector, onto the second collector, a process where the nanofiber, collected on the first collector, is transferred onto the second collector using an additional charged rod, or another process where the second collector, which is made of a material generating static electricity, moves toward the first collector, a portion of the collected nanofiber is transferred onto the second collector, and the second collector moves, may be employed.

Figure 1:
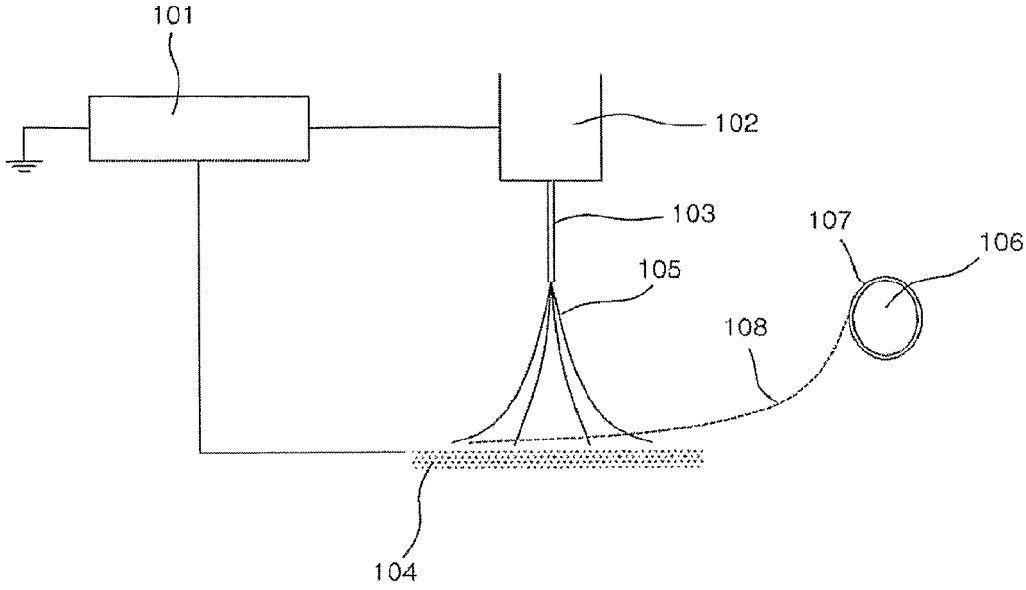
FIG. 1 illustrates an electrospinning process using a multi-collector according to the first embodiment of the present invention.
Figure 2:
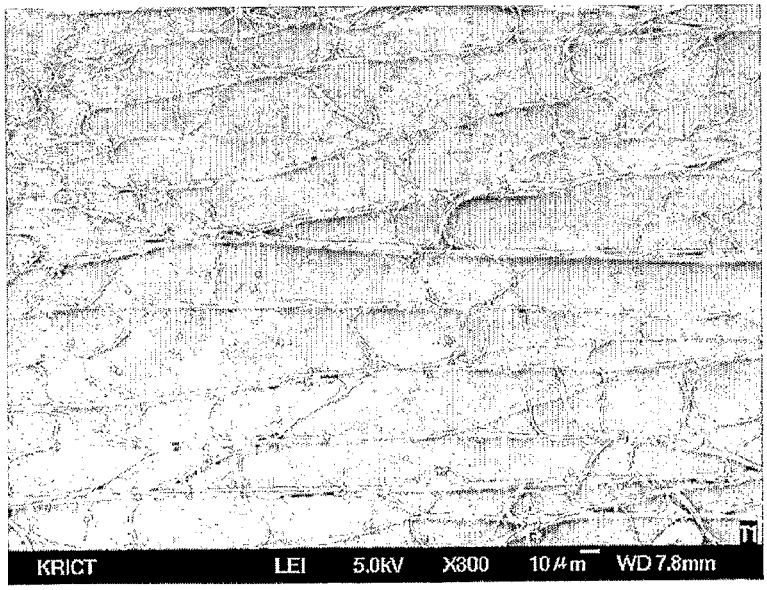
FIG. 2 is a SEM (scanning electron microscope) image of a surface of a nanofiber produced according to the first embodiment of the present invention, which is magnified 300 times.
Figure 3:
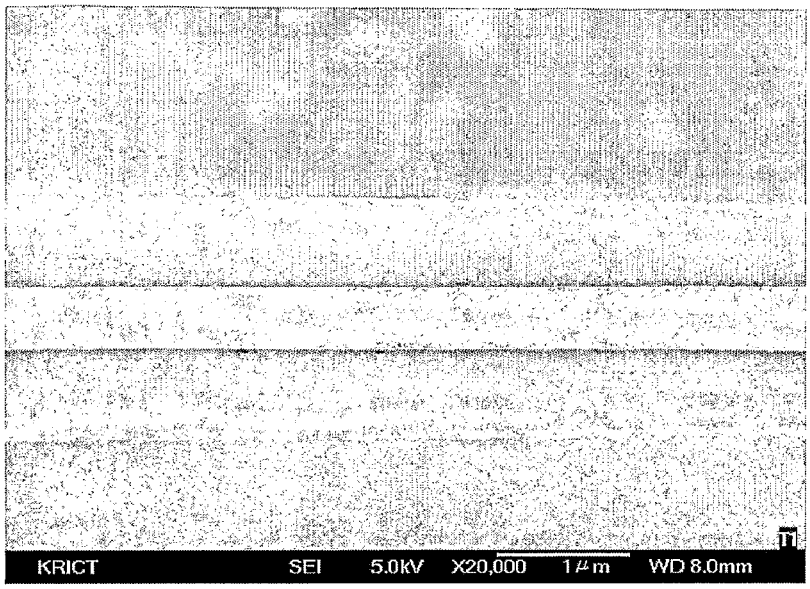
FIG. 3 is a SEM image of the surface of the nanofiber produced according to the first embodiment of the present invention, which is magnified 20,000 times.

FIG. 1 illustrates the first embodiment of the present invention, in which a spinning solution is fed through a spinning solution feeding part 102 into a spinneret 103 to form drops at a tip of the spinneret 103. At this stage, a voltage from a high voltage generator 101, which is set to a predetermined voltage, is applied to the spinning solution feeding part 102 to burst the drops, and thus, the nanofiber is collected on a disk-type first collector 104, which is located perpendicular to the spinneret 103 while rotating. The spun nanofiber 105 collected on the disk-type first collector 104 is transferred so as to be continuously collected on a rotating roll-type second collector using a charged rod, thereby creating a nano-sized long fiber 107 (FIGS. 2 and 3).

Figure 4:
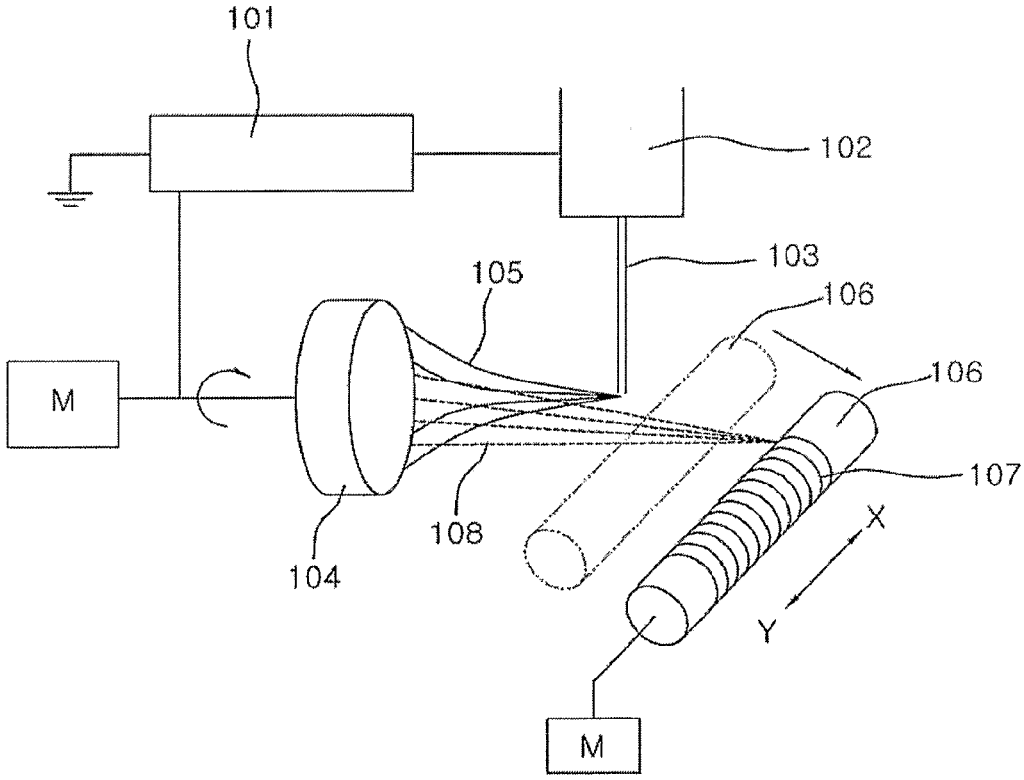
FIG. 4 illustrates an electrospinning process using a multi-collector according to the second embodiment of the present invention.
Figure 5:
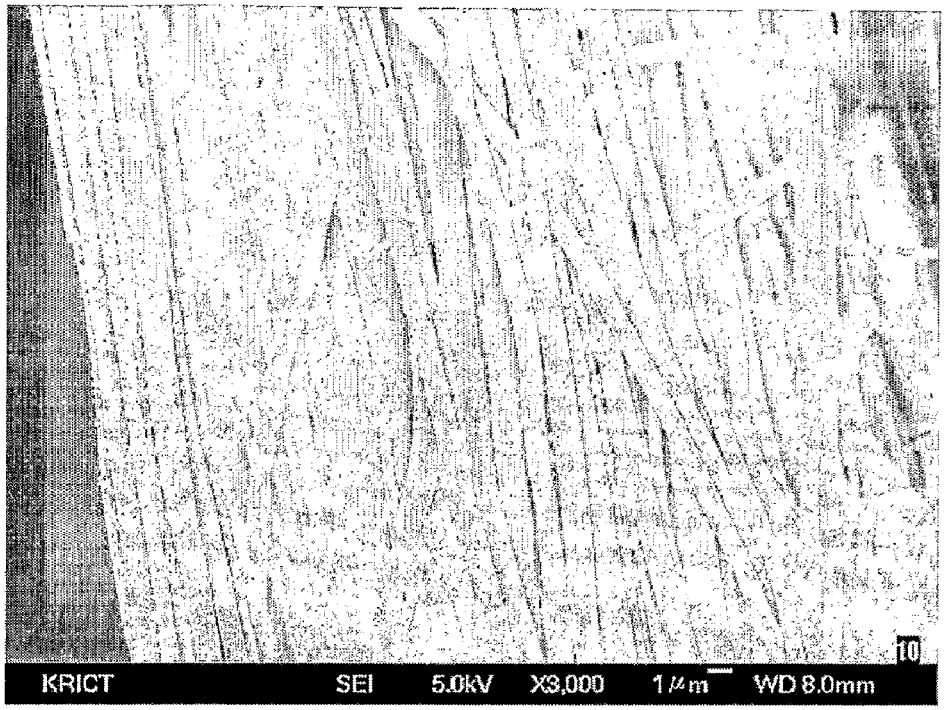
FIG. 5 is a SEM image of a surface of a nanofiber produced according to the second embodiment of the present invention, which is magnified 3,000 times.

FIG. 4 illustrates an electrospinning process using a multi-collector according to the second embodiment of the present invention, in which a nanofiber is collected on a rotating disk-type first collector 104 provided parallel to a spinneret 103. Subsequently, a roll-type second collector 106 moves toward the disk-type first collector 105 to transfer 108 a portion of the spun nanofiber 105, collected on the disk-type first collector 104, onto the roll-type second collector 106 so as to collect the nanofiber in the second collector. Next, while the roll-type second collector 106 becomes distant from the disk-type first collector 104 by a predetermined distant to the extent that the nanofiber 105 is not broken, and the roll-type second collector 106 rotates at 20-80 rpm while axially moving, thereby creating a nanofiber 107 (FIG. 5).

Figure 6:
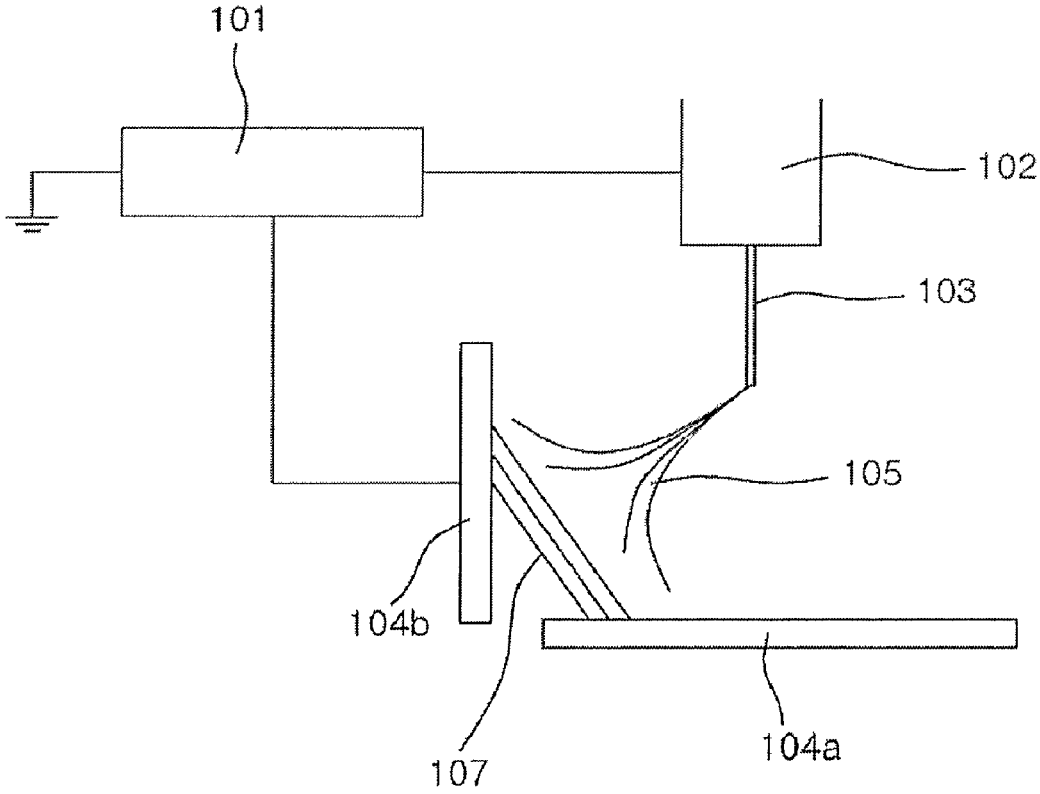
FIG. 6 illustrates an electrospinning process using a multi-collector according to the third embodiment of the present invention.
Figure 7:
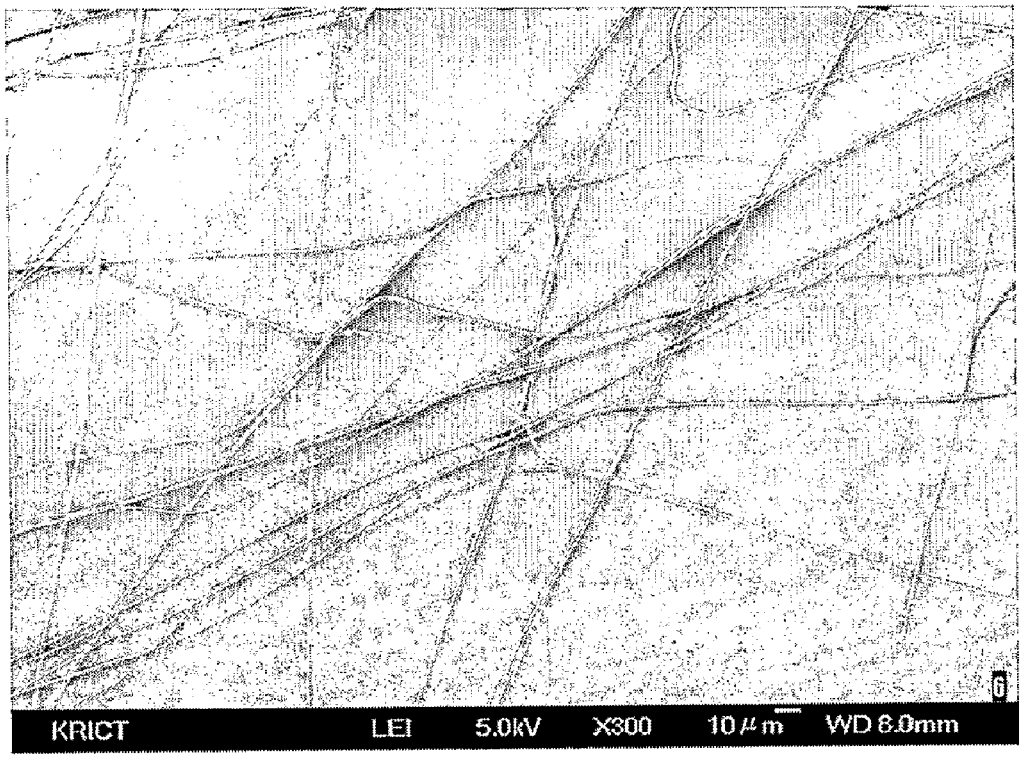
FIG. 7 is a SEM image of a surface of a nanofiber produced according to the third embodiment of the present invention, which is magnified 300 times.

FIG. 6 illustrates an electrospinning process using a multi-collector according to the third embodiment of the present invention. A plate-type first collector 104*a* is provided perpendicular to a spinneret 103 and a plate-type second collector 104*b* is positioned at an angle of 90 degrees to the plate-type first collector 104*a*. In this regard, the plate-type first collector 104*a* is charged, but the plate-type second collector 104*b* is not charged. Drops are continuously collected on the collectors to produce a nano-sized long fiber 107 (FIG. 7).

Figure 8:
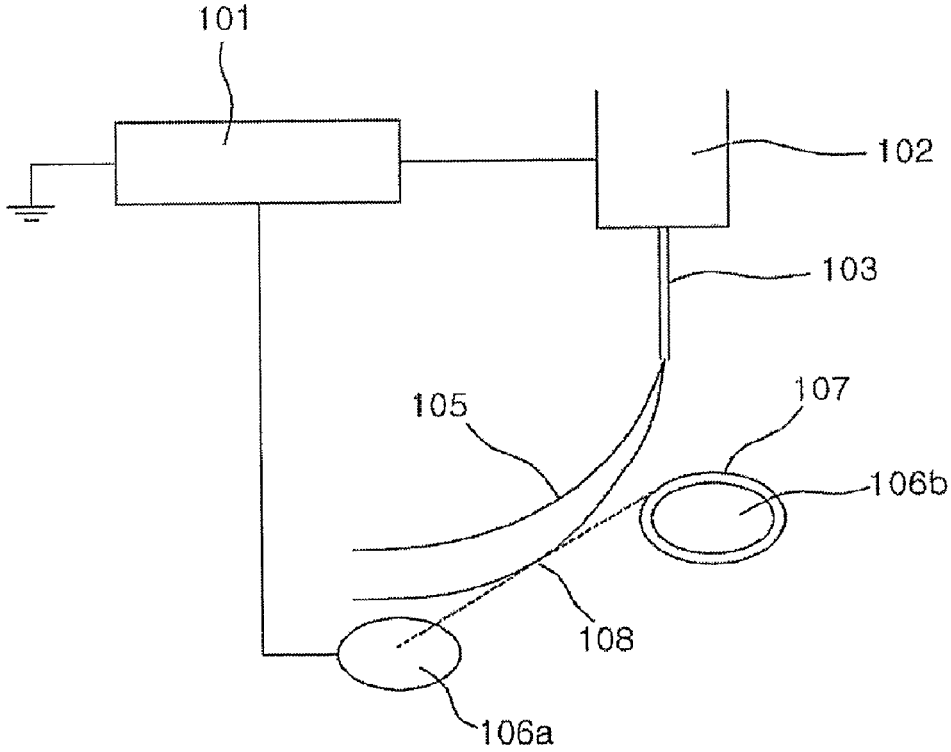
FIG. 8 illustrates an electrospinning process using a multi-collector according to the fourth embodiment of the present invention.
Figure 9:
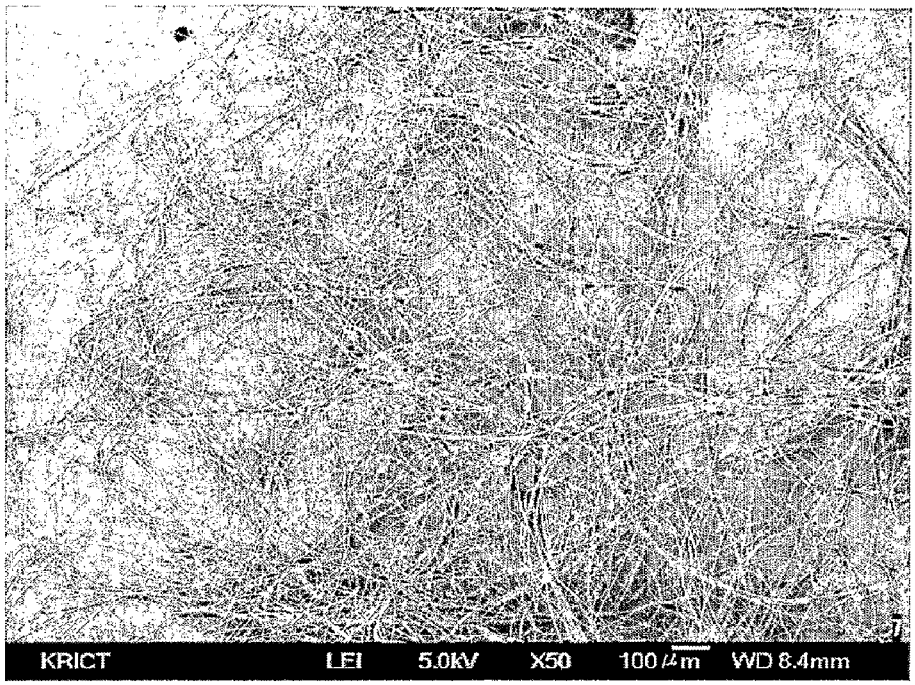
FIG. 9 is a SEM image of a surface of a nanofiber produced according to the fourth embodiment of the present invention, which is magnified 50 times.

FIG. 8 illustrates an electrospinning process using a multi-collector according to the fourth embodiment of the present invention. A roll-type first collector 106*a* is provided perpendicular to a spinneret 103 and positioned at a base part, and a roll-type second collector 106*b* is located over the roll-type first collector 106*a* by a height of 5-10 cm. The roll-type first collector 106*a* and the roll-type second collector 106*b* rotate at the same speed. The nanofiber spun from the spinneret 103 to the first collector 106*a* is recollected on the second collector 106*b* to produce a nanofiber 107 (FIG. 9).

Figure 10:
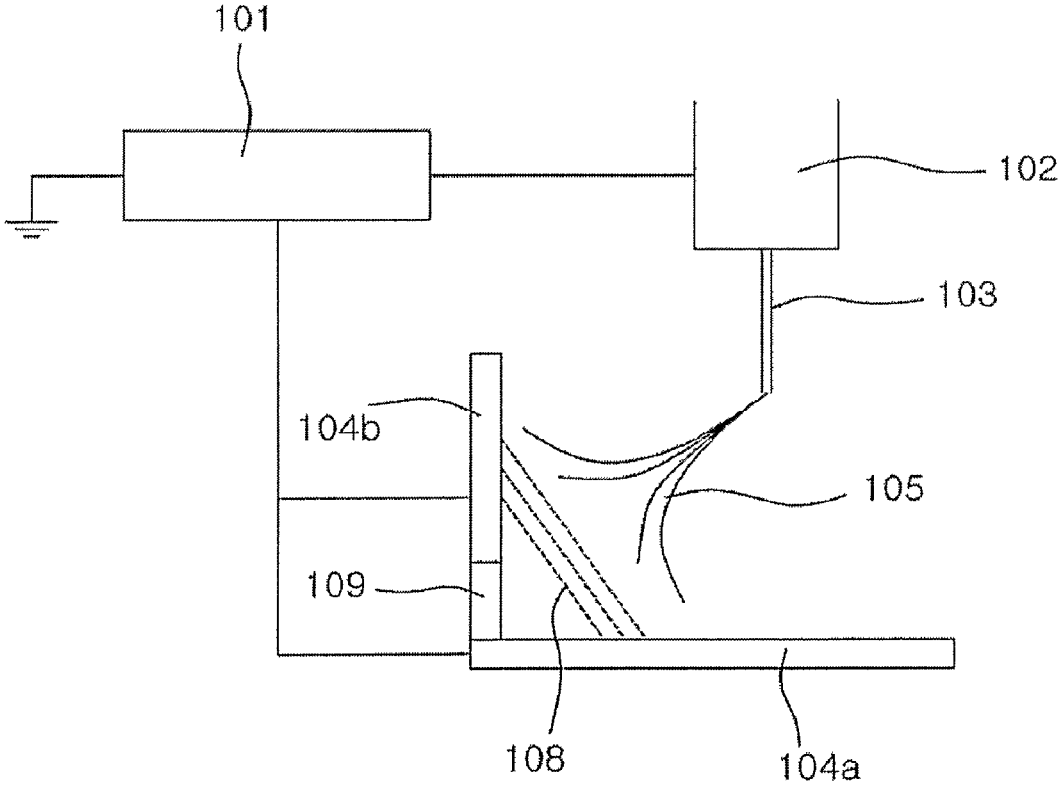
FIG. 10 illustrates an electrospinning process using a multi-collector according to the fifth embodiment of the present invention.
Figure 11:
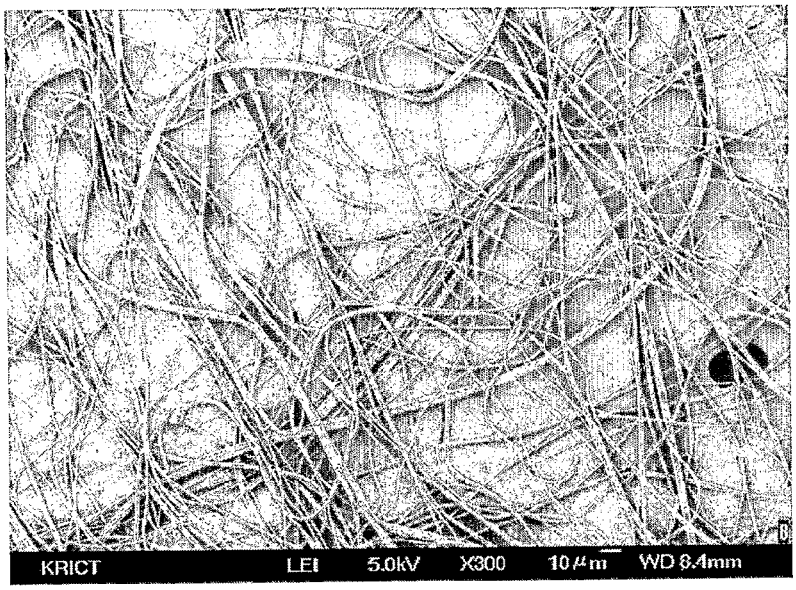
FIG. 11 is a SEM image of a surface of a nanofiber produced according to the fifth embodiment of the present invention, which is magnified 300 times.

FIG. 10 illustrates an electrospinning process using a multi-collector according to the fifth embodiment of the present invention. A spinneret 103 is provided at an upper position and a plate-type first collector 104*a* made of a metal is provided at a lower position so as to be immovable. A plate-type second collector 104*b* is positioned at an angle of 90 degrees to the plate-type collector 104*a*. The plate-type first collector 104*a* and the plate-type second collector 104*b* form an L-shaped dual collector, which is provided with the two plate-type collectors. The plate-type first collector 104*a* is connected to the plate-type second collector 104*b* through a medium part 109, which is located under the plate-type second collector 104*b*. The medium part 109 is made of a nonconductive material so as to independently charge the first and second collectors. Drops are continuously collected on the dual collector to produce a nanofiber 107 (FIG. 11).

Figure 12:
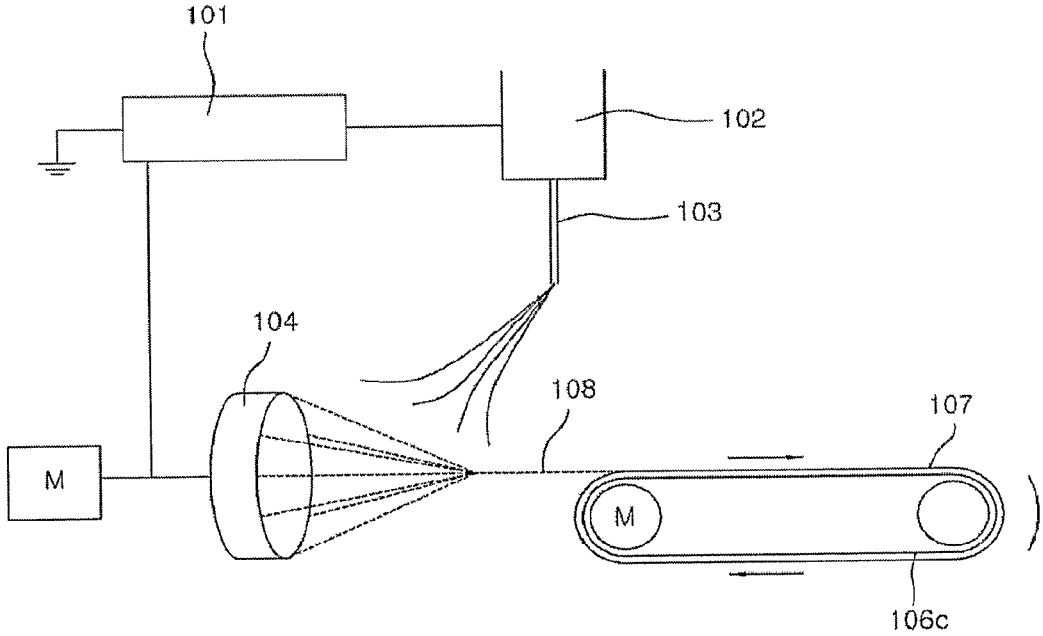
FIG. 12 illustrates an electrospinning process using a multi-collector according to the sixth embodiment of the present invention.
Figure 13:
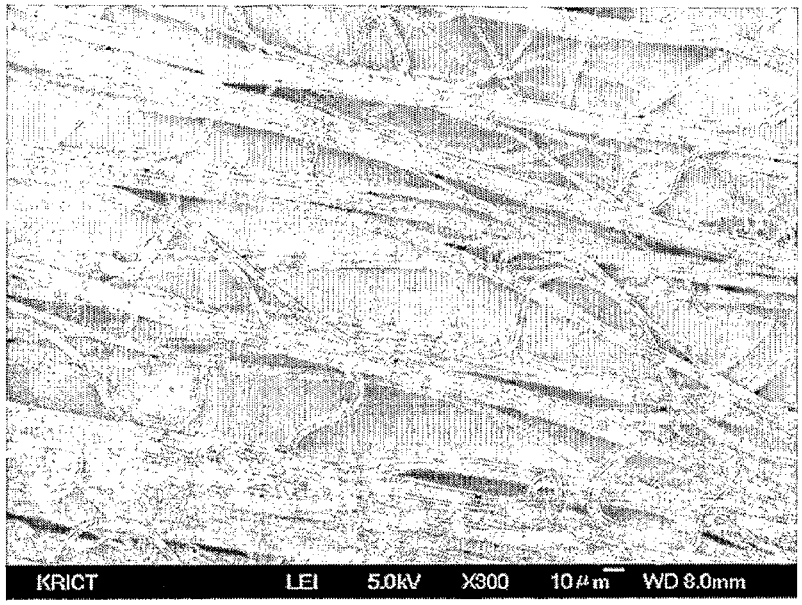
FIG. 13 is a SEM image of a surface of a nanofiber produced according to the sixth embodiment of the present invention, which is magnified 300 times.

FIG. 12 illustrates an electrospinning process using a multi-collector according to the sixth embodiment of the present invention. A spinneret 103 is provided at an upper position, and a disk-type first collector 104 is provided parallel to the spinneret 103 while rotating. Additionally, a roll-type second collector 106*c* consisting of a caterpillar conveyer belt is provided perpendicular to the disk-type first collector 104. A nanofiber 107 is continuously produced using the multi-collector (FIG. 13).

MODE FOR CARRYING OUT THE INVENTION

A better understanding of the present invention may be obtained through the following preparation examples, examples, and a comparative example which are set forth to illustrate, but are not to be construed as the limit of the present invention.

Preparation Example 1

First Preparation of Spinning Solution

A polymer copolymer, which consists of 30 mol % of polyamide-based polymer with an average molecular weight and 70 mol % of polyimide-based polymer with an average molecular weight, was added to a N-methyl-2-pyrrolidine solvent, and sufficiently dissolved at room temperature for 20-30 min using a ultrasonic device. In this regard, a spinning solution contains 25 wt % of polyamide-polyimide copolymer with a number average molecular weight of 1000 based on the solvent.

Preparation Example 2

Second Preparation of Spinning Solution

Polyethylene terephthalate having an intrinsic viscosity of 0.64 was mixed with a polyester copolymer, which contains 30 mol % of isophthalic acid and 15 mol % of diethylene glycol and which has an intrinsic viscosity of 0.60, in a weight ratio of 75:25, and then dissolved in a mixed solvent (50:50) of trifluoroacetic acid and methylene glycol to produce a spinning solution containing 15 wt % of solids.

Preparation Example 3

Preparation of Spinning Melt

A mixed composition, which consists of 30 mol % of polyamide-based polymer with an average molecular weight and 70 mol % of polyimide-based polymer with an average molecular weight, was melted in an electric furnace at 350° C. to produce a spinning melt.

Example 1

First Production of Nano-Sized Long Fiber

As shown in FIG. 1, a spinning solution, which contains 25 wt % of polyamide-polyimide copolymer produced through preparation example 1, was fed through a spinning solution feeding part 102 to a spinneret 103 at a speed of 0.3 ml/min, thereby forming a drop at a tip of the spinneret having a diameter of 0.42 mm. At this stage, a voltage was applied to the spinning solution feeding part 102 using a high voltage generator 101 in which a critical voltage was set to 1.5 kv/cm to burst the drop, and consequently, a nanofiber is collected on a disk-type first collector 104 which was provided perpendicular to the spinneret 103 and rotated at 40 rpm. Subsequently, the spun nanofiber 105 was transferred from the disk-type first collector 104 to a roll-type second collector, rotating at 20 rpm, using an additional charged rod so as to be continuously collected therein. At this stage, a distance between the spinneret 103 and the disk-type first collector 104 was set to 10 cm, and a distance between the disk-type first collector 104 and the roll-type second collector 106 was set to 10 cm. The resulting nanofiber was observed while being magnified 300 and 20,000 times using a scanning electron microscope, thereby confirming that a long fiber having an average diameter of 0.4 μm was produced (FIGS. 2 and 3).

Example 2

Second Production of Nano-Sized Long Fiber

A spinning solution, which contains 25 wt % of polyamide-polyimide copolymer produced through preparation example 1, was fed through a spinning solution feeding part 102 to a spinneret 103 at a speed of 0.3 ml/min, thereby forming a drop at a tip of the spinneret having a diameter of 0.42 mm. At this stage, a voltage was applied using a high voltage generator 101 in which a critical voltage was set to 1.3 kv/cm to burst the drop, and consequently, a nanofiber is collected on a disk-type first collector 104 which was provided parallel to the spinneret 103 and rotated at 40 rpm. Subsequently, a roll-type second collector 106 moved toward the disk-type first collector 104, so that they were spaced from each other by a distance of 4 cm. Consequently, a portion of the spun nanofiber 105, which was collected on the disk-type first collector 104, was collected onto the roll-type second collector 106. Next, the roll-type second collector 106 became distant from the disk-type first collector 104 by a predetermined distance to the extent that the spun nanofiber 105 was not broken, and the roll-type second collector 106 rotated at 20-60 rpm while axially moving, thereby creating the resulting nanofiber. At this stage, a distance between the spinneret 103 and the disk-type first collector 104 was 4 cm, and a distance between the disk-type first collector 104 and the roll-type second collector 106 was 10 cm (FIG. 4). The resulting nanofiber was observed while being magnified 3,000 times using a scanning electron microscope, thereby confirming that a twisted long fiber having an average diameter of 0.8 μm was produced (FIG. 5).

Example 3

Third Production of Nano-Sized Long Fiber

A spinning solution, which contains 25 wt % of polyamide-polyimide copolymer produced through preparation example 1, was fed through a spinning solution feeding part 102 to a spinneret 103 at a speed of 0.3 ml/min, thereby forming a drop at a tip of the spinneret having a diameter of 0.42 mm. An electrospinning process was conducted under the same conditions as example 1 except that a procedure of FIG. 6 was carried out. A plate-type first collector 104*a* is made of a metal plate perpendicular to the spinneret, and a plate-type second collector 104*b* was at an angle of 90 degrees to the plate-type first collector 104*a* and spaced from the first collector by a distance of 3-5 cm. At this stage, the spinneret was charged into "+", the plate-type first collector 104*a* was charged into "−", and the plate-type second collector 104*b* was not charged. Thereby, a spun nanofiber 105 was collected.

As shown in FIG. 7, a surface of the nanofiber produced through example 3 was observed using a scanning electron microscope while being magnified 300 times, thereby confirming that the resulting nanofiber was a nano-sized long and twisted fiber having an average diameter of 1.4 μm.

Example 4

Fourth Production of Nano-Sized Long Fiber

A spinning solution, which contains 25 wt % of polyamide-polyimide copolymer produced through preparation example 1, was fed through a spinning solution feeding part 102 to a spinneret 103 at a speed of 0.3 ml/min, thereby forming a drop at a tip of the spinneret having a diameter of 0.42 mm. An electrospinning process was conducted under the same conditions as example 1 except that a procedure of FIG. 8 was carried out. The spinneret 103 having a diameter of 0.42 mm was provided at an upper position, and two roll-type collectors 106*a*, 106*b* were provided at a lower position. The first collector 106*a*, in which a spun nanofiber was first collected, was a roll type, made of a metal, and rotated at 40 rpm. The roll-type second collector 106*b* was located over the roll-type first collector 106*a* by a height of 5-10 cm and rotated at the same rotating speed as the first collector. The roll-type second collector 106*b* was made of a glass capable of generating static electricity. At this stage, the spinneret 103 was charged into "+", and the roll-type first collector 106*a* at a bottom position was charged into "−".

As shown in FIG. 9, a surface of the nanofiber produced through example 4 was observed using a scanning electron microscope while being magnified 50 times, thereby confirming that the resulting nanofiber was a nano-sized long and twisted fiber having an average diameter of 5.1 μm.

Example 5

Fifth Production of Nano-Sized Long Fiber

A spinning solution, which contains 25 wt % of polyamide-polyimide copolymer produced through preparation example 1, was fed through a spinning solution feeding part 102 to a spinneret 103 at a speed of 0.3 ml/min, thereby forming a drop at a tip of the spinneret having a diameter of 0.42 mm. An electrospinning process was conducted under the same conditions as example 1 except that a procedure of FIG. 10 was carried out. The spinneret 103 having the diameter of 0.42 mm was provided at an upper position, and a plate-type first collector 104*a* made of a metal was provided at a lower position so as to be immovable. A plate-type second collector 104*b* was at an angle of 90 degrees to the plate-type first collector 104*a*. The plate-type first collector 104*a* and the plate-type second collector 104*b* were made of the same material and constituted an L-shaped dual collector. The plate-type first collector 104*a* and the plate-type second collector 104*b* formed the L-shaped dual collector, which was provided with the two plate-type collectors. The plate-type first collector 104*a* was connected through a medium part 109, which was located under the plate-type second collector 104*b*, to the plate-type second collector 104*b*. The medium part 109 was made of a nonconductive material so as to independently charge the first and second collectors. At this stage, the spinneret 103 was charged into "+", and the L-shaped dual collector 104*a*, 104*b* was charged into "−".

As shown in FIG. 11, a surface of the nanofiber produced through example 5 was observed using a scanning electron microscope while being magnified 300 times, thereby confirming that the resulting nanofiber was a nano-sized long and twisted fiber having an average diameter of 2.5 μm.

Example 6

Sixth Production of Nano-Sized Long Fiber

A spinning solution, which contains 25 wt % of polyamide-polyimide copolymer produced through preparation example 1, was fed through a spinning solution feeding part 102 to a spinneret 103 at a speed of 0.3 ml/min, thereby forming a drop at a tip of the spinneret having a diameter of 0.42 mm. An electrospinning process was conducted in the same manner as a procedure of FIG. 12. A spinneret 103 having a diameter of 0.42 mm was provided at an upper position, and a disk-type first collector 104 was provided parallel to the spinneret 103 while rotated at 50 rpm. Additionally, a roll-type second collector 106*c* consisting of a caterpillar conveyer belt was provided perpendicular to the disk-type first collector 104. At this stage, the electrospinning process was conducted under conditions that a distance between the spinneret 103 and the disk-type first collector 104 was 4 cm, a critical voltage was set to 1.3 kv/cm, the spinneret was charged into "+", and the disk-type first collector 104 was charged into "−", thereby continuously producing a fiber.

As shown in FIG. 13, a surface of a nanofiber produced through example 6 was observed using a scanning electron microscope while being magnified 300 times, thereby confirming that the resulting nanofiber was a nano-sized long and twisted fiber having an average diameter of 4.5 μm.

Comparative Example 1

Production of Nanofiber

Figure 14:
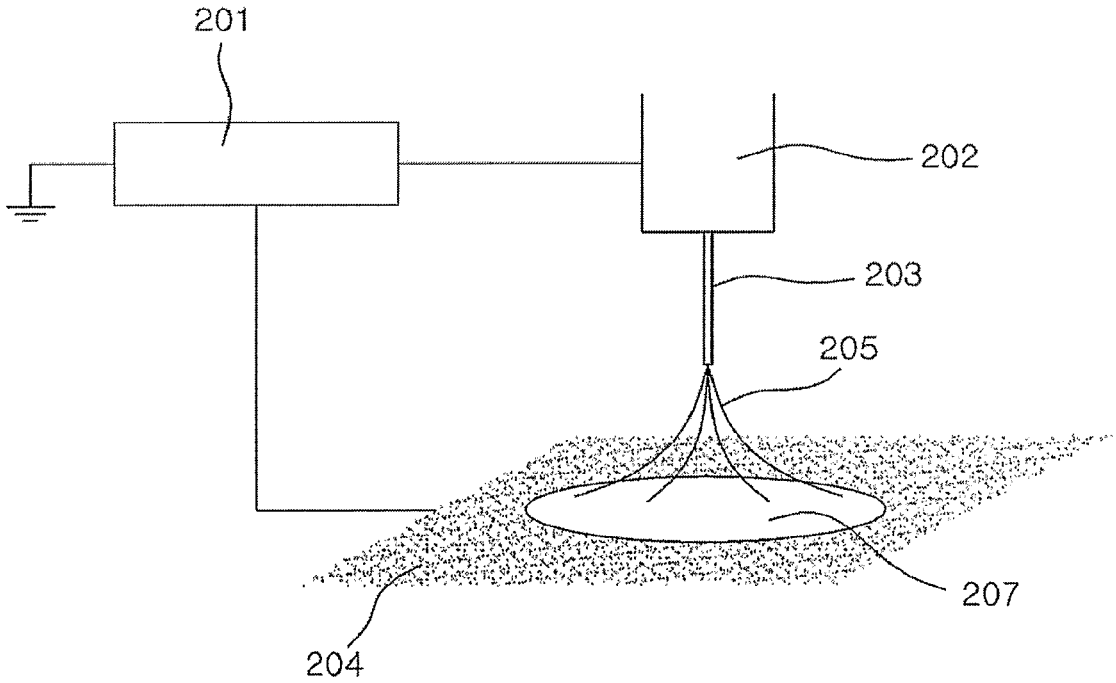
FIG. 14 illustrates a conventional electrospinning process employing a single collector.

A spinning solution, which contains 25 wt % of polyamide-polyimide copolymer produced through preparation example 1, was fed into a spinning solution feeding part 202. When a voltage was applied using a high voltage generator 201 in which a critical voltage was set to 1 kv/cm, the spinning solution was spun from a tip of a spinneret 203 in drops. Subsequently, after the spinning, the spinning solution was collected on a plate-type collector 204 which was perpendicular to the spinneret and consisted of a metal mesh (FIG. 14). A nanofiber web 207 collected on the collector 204 was observed while being magnified 300 times using a scanning electron microscope, thereby confirming that the resulting web was produced in the type of non-woven fabric as shown in FIG. 15. Additionally, the nanofiber web was observed while being magnified 20,000 times, thereby confirming that the nanofibers constituting the web had an average diameter of 0.5 μm (FIG. 15). In this regard, a diameter of the spinneret, a distance between the spinneret and the metal collector, and the critical voltage were the same as those of example 1.

Average diameters and diameter ranges of the nanofibers produced through examples 1 to 6 and comparative example 1 are described in Table 1.

TABLE 1

Diameters of the nanofibers

| Example | Average diameter (nm) | Diameter range (nm) |
|---|---|---|
| Example 1 | 400 | 90-800 |
| Example 2 | 700 | 200-2200 |
| Example 3 | 1200 | 400-4500 |

TABLE 1-continued

| Diameters of the nanofibers | | |
|---|---|---|
| Example | Average diameter (nm) | Diameter range (nm) |
| Example 4 | 5100 | 2000-11000 |
| Example 5 | 2500 | 900-5100 |
| Example 6 | 4400 | 3200-10000 |
| Comparative example 1 | 500 | 200-1500 |

From Table 1, it can be seen that the fibers produced through examples 1 to 6 and comparative example 1 are nanofibers each having a nano-sized diameter range. Particularly, the diameters of the nanofibers produced through examples 1 to 6 can be controlled depending on the critical voltage and a moving speed of the spinning solution or the spinning melt fed into the spinneret. Furthermore, the nanofiber produced through comparative example 1 has the type of non-woven fabric (FIGS. 15 and 16). On the other hand, it can be seen that the nanofibers produced through examples 1 to 6 are filament type (twisted) long fibers, from the SEM image results of FIGS. 2, 5, 7, 9, 11, and 13.

INDUSTRIAL APPLICABILITY

As described above, a filament type nano-sized long fiber, which is produced using an improved electrospinning process according to the present invention, has mechanical properties that are better than a conventional nanofiber non-woven fabric, thereby being applied as a substitute to all fields employing a conventional fiber having a micron-sized diameter. For example, first, the fiber of the present invention is useful as medical filters for kidney dialysis and purification of the blood, and various membrane reinforcing materials for genetic separation.

Second, the fiber of the present invention is useful to produce ultra-thin reinforcing films and ultra-slim PCBs in electric/electronic fields. Third, the fiber of the present invention may be useful for ultra-small and ultra-light flying bodies or unmanned flying robots.

Fourth, the fiber of the present invention is useful as a reinforcing material for an optical cable in an optical communication field.

What is claimed is:

1. A filament bundle type nano-sized fiber produced through a process comprising electrospinning a spinning solution or a spinning melt in drops using a spinneret to which a critical voltage is applied, and continuously collecting the spun drops on a multi-collector, the spinning solution having been produced by dissolving a copolymer consisting of two or more kinds of polymers in a solvent, the spinning melt being produced by melting the polymers, and the multi-collector is selected from the group consisting of a plate type collector, a roll type collector, and a combination thereof wherein each of the polymers is a polyamide-polyimide copolymer including a compound expressed by Formula 1, in which m is 1-99 mol %, and the other compound expressed by Formula 2, in which n is 1-99 mol %:

Formula 1

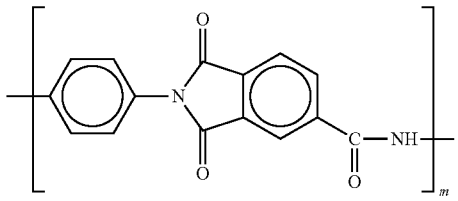

Formula 2

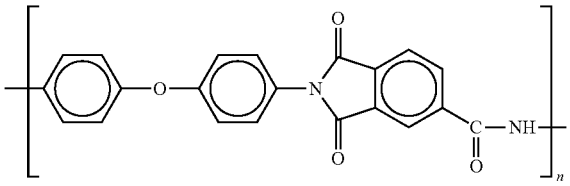

and a filament type nanofiber is a nano-sized long fiber having a diameter of 1-1,000 nm.

2. The filament bundle type nano-sized fiber as set forth in claim 1, wherein each of the polymers is a mixture of two or more selected from the group consisting of polyimide, polyamide, polyethylene, polypropylene, polyester, polyvinylidene fluoride, polyacrylonitrile, polysulfone, and polyethylene oxide.

3. The filament bundle type nano-sized fiber as set forth in claim 1, wherein each of the polymers contains one or more amine groups selected from the group consisting of monoamine, diamine, triamine, and tetramine.

4. The filament bundle type nano-sized fiber as set forth in claim 1, wherein the polyamide-polyimide copolymer has a number average molecular weight of 200-1,000,000.

5. The filament bundle type nano-sized fiber as set forth in claim 1, wherein the solvent is any one selected from the group consisting of N-methyl-2-pyrrolidone, γ-butyrolactone, 2-butoxyethanol, dimethylacetamide, and dimethylformamide.

* * * * *